US007498109B2

(12) United States Patent
Wu et al.

(10) Patent No.: US 7,498,109 B2
(45) Date of Patent: Mar. 3, 2009

(54) ELECTROPHOTOGRAPHIC IMAGING MEMBER UNDERCOAT LAYERS

(75) Inventors: Jin Wu, Webster, NY (US); Geoffrey M. T. Foley, Fairport, NY (US); Satchidanand Mishra, Webster, NY (US); Liang-bih Lin, Rochester, NY (US); Anthony M. Horgan, Pittsford, NY (US); Yonn K. Rasmussen, Pittsford, NY (US); Kathleen M. Carmichael, Williamson, NY (US); Edward F. Grabowski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 319 days.

(21) Appl. No.: 11/481,731

(22) Filed: Jul. 6, 2006

(65) Prior Publication Data

US 2008/0008950 A1 Jan. 10, 2008

(51) Int. Cl.
*G03G 5/047* (2006.01)
*G03G 5/10* (2006.01)

(52) U.S. Cl. ..... 430/60; 430/58.8; 430/58.75; 430/65; 399/159

(58) Field of Classification Search ..... 430/58.8, 430/69, 56, 58.75, 60, 65; 399/159
See application file for complete search history.

(56) References Cited

U.S. PATENT DOCUMENTS

| | | | | |
|---|---|---|---|---|
| 3,121,006 | A | 2/1964 | Middleton et al. | 430/31 |
| 4,233,384 | A | 11/1980 | Turner et al. | 430/58.75 |
| 4,265,990 | A | 5/1981 | Stolka et al. | 430/58.8 |
| 4,298,697 | A | 11/1981 | Baczek et al. | 521/27 |
| 4,299,897 | A | 11/1981 | Stolka et al. | 430/58.8 |
| 4,306,008 | A | 12/1981 | Pai et al. | 430/58.8 |
| 4,338,390 | A | 7/1982 | Lu | 430/108.2 |
| 4,439,507 | A | 3/1984 | Pan et al. | 430/58.8 |
| 4,464,450 | A | 8/1984 | Teuscher | 430/58.8 |
| 4,560,635 | A | 12/1985 | Hoffend et al. | 430/108.2 |
| 4,921,769 | A | 5/1990 | Yuh et al. | 430/64 |
| 4,921,773 | A | 5/1990 | Melnyk et al. | 430/132 |
| 5,482,811 | A | 1/1996 | Keoshkerian et al. | 430/135 |
| 5,725,985 | A | 3/1998 | Nealey et al. | 430/58.05 |
| 5,958,638 | A | 9/1999 | Katayama et al. | 430/65 |
| 6,017,666 | A | 1/2000 | Nealey et al. | 430/59.4 |
| 6,132,912 | A | 10/2000 | Fuller et al. | 430/58.8 |
| 6,156,468 | A | 12/2000 | Wehelie et al. | 430/65 |
| 6,177,219 | B1 | 1/2001 | Yuh et al. | 430/65 |
| 6,255,027 | B1 | 7/2001 | Wehelie et al. | 430/65 |
| 6,287,737 | B1 | 9/2001 | Ong et al. | 430/58.8 |
| 6,444,386 | B1 | 9/2002 | Liu et al. | 430/64 |
| 2007/0026330 | A1 * | 2/2007 | Wu et al. | 430/58.05 |
| 2007/0059621 | A1 * | 3/2007 | Wu et al. | 430/60 |

OTHER PUBLICATIONS

U.S. Appl. No. 11/211,757, filed Aug. 26, 2005, of Jin Wu et al., entitled "Novel Thick Undercoats" 27 pages, not yet published.
U.S. Appl. No. 10/942,277, filed Sep. 16, 2004, of Liang-Bih Lin et al., entitled "Photoconductive Imaging Members", published Mar. 16, 2006.
U.S. Appl. No. 11/193,241, filed Jul. 28, 2005, of Jin Wu et al., entitled "Photoreceptor Layer Having Thiophosphate Lubricants", not yet published.
U.S. Patent Application of Jin Wu et al. entitled "Electrophotographic Imaging Member Undercoat Layers" filed Jul. 6, 2006, 32 pages.
U.S. Patent Application filed Jun. 6, 2006, of Jin Wu et al., entitled "Imaging Members and Method for Sensitizing a Charge Generation Layer of An Imaging Member" 52 pages, not yet published.
U. S. Patent Application of Jin Wu et al., illustrating, in embodiments, and antistatic anticurl backing layer comprising thiophosphates, not yet filed.

* cited by examiner

*Primary Examiner*—John L Goodrow
(74) *Attorney, Agent, or Firm*—Marylou J. Lavole, Esq. LLC

(57) ABSTRACT

An imaging member including a substrate; a charge generation layer positioned on the substrate; at least one charge transport layer positioned on the charge generation layer; and an undercoat layer positioned on the substrate on a side opposite the charge generation layer, the undercoat layer comprising a thiophosphate, and optionally one or more additional undercoat layer components.

31 Claims, No Drawings

ELECTROPHOTOGRAPHIC IMAGING MEMBER UNDERCOAT LAYERS

CROSS-REFERENCE TO RELATED APPLICATIONS

Illustrated in U.S. Pat. No. 7,312,007, U.S. Ser. No. 10/942,277, of Liang-bih Lin et al., filed Sep. 16, 2004, entitled 'Photoconductive Imaging Members,' the disclosure of which is totally incorporated herein by reference, is a photoconductive member containing a hole blocking layer, a photogenerating layer, and a charge transport layer, and wherein the hole blocking layer contains a metallic component like a titanium oxide and a polymeric binder.

Illustrated in commonly assigned, co-pending U.S. patent application Ser. No. 11/481,642, U.S. Patent Publication 20080008947 of Jin Wu et al., filed of even date herewith, the disclosure of which is totally incorporated by reference herein, is an imaging member including a substrate; a charge generation layer positioned on the substrate; at least one charge transport layer positioned on the charge generation layer; and an undercoat layer positioned on the substrate on a side opposite the charge generation layer, the undercoat layer comprising a binder component and a metallic component comprising metal thiocyanate and metal oxide.

Illustrated in commonly assigned, co-pending U.S. patent application Ser. No. 11/481,729, U.S. Patent Publication 20080008948 of Jin Wu et al., filed of even date herewith, the disclosure of which is totally incorporated by reference herein, is an imaging member including a substrate; a charge generation layer positioned on the substrate, the charge generation layer comprising thiophosphate; at least one charge transport layer positioned on the charge generation layer; and an undercoat layer positioned on the substrate on a side opposite the charge generation layer.

Illustrated in commonly assigned U.S. patent application of Jin Wu et al., Ser. No. 11/491,691, U.S. Patent Publication 20080020309 the disclosure of which is hereby incorporated by reference herein in its entirety, is, in embodiments, an antistatic anticurl backing layer comprising thiophosphates.

BACKGROUND

The present disclosure is generally related to imaging members, also referred to as photoreceptors, photosensitive members, and the like, and in embodiments to undercoat layers containing metal oxide and electrographic imaging members containing the undercoat layers. The imaging members may be used in copy, printer, fax, scan, multifunction machines, and the like. In embodiments, the methods reduce scratching, abrasion, corrosion, fatigue, and cracking, and facilitate cleaning and durability of devices, for example active matrix imaging devices, such as active matrix belts.

The demand for improved print quality in xerographic reproduction is increasing, especially with the advent of color. Common print quality issues are strongly dependent on the quality of the undercoat layer (UCL). Conventional materials used for the undercoat or blocking layer have been problematic. In certain situations, a thicker undercoat is desirable, but the thickness of the material used for the undercoat layer is limited by the inefficient transport of the photoinjected electrons from the charge generation layer to the substrate. If the undercoat layer is too thin, then incomplete coverage of the substrate results due to wetting problems on localized unclean substrate surface areas. The incomplete coverage produces pin holes which can, in turn, produce print defects such as charge deficient spots (CDS) and bias charge roll (BCR) leakage breakdown. Other problems include "ghosting," which is thought to result from the accumulation of charge somewhere in the photoreceptor. Removing trapped electrons and holes residing in the imaging members is desirable to preventing ghosting. During the exposure and development stages of xerographic cycles, the trapped electrons are mainly at or near the interface between charge generating layer (CGL) and undercoating layer (UCL) and holes mainly at or near the interface between charge generating layer and charge transport layer (CTL). The trapped charges can migrate according to the electric field during the transfer stage, where the electrons can move from the interface of CGL/UCL to CTL/CGL or the holes from CTL/CGL to CGL/UCL and became deep traps that are no longer mobile. Consequently, when a sequential image is printed, the accumulated charge results in image density changes in the current printed image that reveals the previously printed image. Thus, there is a need, which the present embodiments address, for a way to minimize or eliminate charge accumulation in photoreceptors, without sacrificing the desired thickness of the undercoat layer.

The terms "charge blocking layer" and "blocking layer" are generally used interchangeably with the phrase "undercoat layer".

In the art of electrophotography, a photoreceptor, imaging member, or the like, comprising a photoconductive insulating layer on a conductive layer is imaged by first uniformly electrostatically charging the surface of the photoconductive insulating layer. The photoreceptor is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Electrophotographic imaging members or photoreceptors are usually multilayered photoreceptors that comprise a substrate support, an electrically conductive layer, an optional hole blocking layer, an optional adhesive layer, a charge generating layer, and a charge transport layer in either a flexible belt form or a rigid drum configuration. Multilayered flexible photoreceptor members may include an anti-curl layer on the backside of the substrate support, opposite to the side of the electrically active layers, to render the desired photoreceptor flatness.

Examples of photosensitive members having at least two electrically operative layers including a charge generation layer and diamine containing transport layer are disclosed in U.S. Pat. Nos. 4,265,990; 4,233,384; 4,306,008; 4,299,897; and 4,439,507, the disclosures of each of which are hereby incorporated by reference herein in their entireties.

Photoreceptors can also be single layer devices. For example, single layer organic photoreceptors typically comprise a photogenerating pigment, a thermoplastic binder, and hole and electron transport materials.

As more advanced, higher speed electrophotographic copiers, duplicators and printers were developed, the performance requirements for the xerographic components increased. Moreover, complex, highly sophisticated, duplicating and printing systems employing flexible photoreceptor belts, operating at very high speeds, have also placed stringent mechanical requirements and narrow operating limits as well on photoreceptors.

The charge generation layer is capable of photogenerating holes and injecting the photogenerated holes into the charge transport layer. The charge generation layer used in multilayered photoreceptors include, for example, inorganic photoconductive particles or organic photoconductive particles dispersed in a film forming polymeric binder. Inorganic or organic photoconductive material may be formed as a continuous, homogenous charge generation section. Many suitable photogenerating materials known in the art may be used, if desired.

Electrophotographic imaging members or photoreceptors having varying and unique properties are needed to satisfy the vast demands of the xerographic industry. The use of organic photogenerating pigments such as perylenes, bisazos, perinones, and polycyclic quinines in electrophotographic applications is well known. Generally, layered imaging members with the aforementioned pigments exhibit acceptable photosensitivity.

Conventional binders used in electrophotographic imaging members typically contain vinyl chloride. Examples of conventional binders are disclosed in U.S. Pat. No. 5,725,985, incorporated herein by reference in its entirety, and U.S. Pat. No. 6,017,666, incorporated herein by reference in its entirety. Additionally, electrophotographic imaging members may be non-halogenated polymeric binders, such as a non-halogenated copolymers of vinyl acetate and vinyl acid.

Conventional electrophotographic imaging members may have an undercoat layer interposed between the conductive support and the charge generation layer. Examples of conventional undercoat layers are disclosed in U.S. Pat. Nos. 4,265,990; 4,921,769; 5,958,638; 6,132,912; 6,287,737; and 6,444,386; incorporated herein by reference in their entireties.

The appropriate components and processes of the above co-pending applications may be selected for the present disclosure in embodiments thereof. Further, the appropriate components and process aspects of the each of the foregoing U.S. patents may be selected for the present disclosure in embodiments thereof.

SUMMARY

Embodiments disclosed herein include an imaging member comprising a substrate; a charge generation layer positioned on the substrate; at least one charge transport layer positioned on the charge generation layer; and an undercoat layer positioned on the substrate on a side opposite the charge generation layer, the undercoat layer comprising a thiophosphate, and optionally one or more additional undercoat layer components.

In embodiments, the one or more additional undercoat layer components are selected from the group consisting of binder components, metal oxides, silanes, organometallic compounds, and mixtures and combinations thereof. In embodiments, the one or more additional undercoat layer components comprise a metal oxide and a binder component. In various other embodiments, the one or more additional undercoat layer components comprise a silane, an optional organometallic compound, and an optional binder component.

Embodiments disclosed herein further include a process for fabricating an imaging member exhibiting low imaging ghosting.

Embodiments disclosed herein also include an imaging member comprising a substrate; a charge generation layer positioned on the substrate; at least one charge transport layer positioned on the charge generation layer; and an undercoat layer positioned on the substrate on a side opposite the charge generation layer, the undercoat layer comprising a binder component, zinc dialkyldithiophosphate (ZDDP) and $TiO_2$.

Embodiments disclosed herein also include an imaging member comprising a substrate; a charge generation layer positioned on the substrate; at least one charge transport layer positioned on the charge generation layer; and an undercoat layer positioned on the substrate on a side opposite the charge generation layer, the undercoat layer comprising an aminosilane and zinc dialkyldithiophosphate (ZDDP).

Embodiments disclosed herein also include an imaging member comprising a substrate; a charge generation layer positioned on the substrate; at least one charge transport layer positioned on the charge generation layer; and an undercoat layer positioned on the substrate on a side opposite the charge generation layer, the undercoat layer comprising zinc dialkyldithiophosphate and optionally one or more additional undercoat layer components selected from the group consisting of binder components, metal oxides, silanes, organometallic compounds, and mixtures and combinations thereof.

In addition, embodiments disclosed herein an image forming apparatus for forming images on a recording medium comprising a) a photoreceptor member having a charge retentive surface to receive an electrostatic latent image thereon, wherein said photoreceptor member comprises a metal or metallized substrate, a charge generation layer positioned on the substrate; at least one charge transport layer positioned on the charge generation layer; and an undercoat layer positioned on the substrate on a side opposite the charge generation layer, the undercoat layer comprising a thiophosphate and optionally one or more additional undercoat layer components; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

DETAILED DESCRIPTION

This disclosure is generally directed to imaging members, and more specifically, directed to multilayered photoconductive members with an undercoat layer comprising, in embodiments, for example, a suitable hole blocking component of, for example, a silane, an organometallic compound, a titanium oxide, a thiophosphate, and a binder or polymer. The blocking layer, which can also be referred to as an undercoat layer and possesses conductive characteristics in embodiments, enables, for example, high quality developed images or prints, excellent imaging member lifetimes and thicker layers which permit excellent resistance to charge deficient spots, or undesirable plywooding, and also increases the layer coating robustness, and wherein honing of the supporting substrates may be eliminated thus permitting, for example, the generation of economical imaging members. The undercoat layer is in embodiments in contact with the supporting substrate and is in embodiments situated between the supporting substrate and the photogenerating layer comprised of photogenerating pigments, such as those illustrated in U.S. Pat. No. 5,482,811, the disclosure of which is totally incorporated herein by reference, especially Type V hydroxygallium phthalocyanine.

The imaging members herein in embodiments exhibit higher photosensitivity, lower residual potential ($V_r$), ghosting reduction, excellent cyclic/environmental stability, and substantially no adverse changes in their performance over extended time periods since the imaging members comprise a mechanically robust and solvent thick resistant undercoat layer enabling the coating of a subsequent photogenerating layer thereon without structural damage, and which undercoat layer can be easily coated on the supporting substrate by various coating techniques of, for example, dip or slot-coating. The aforementioned photoresponsive, or photoconductive imaging members can be negatively charged when the photogenerating layer is situated between the charge transport layer and the hole blocking layer deposited on the substrate.

Processes of imaging, especially xerographic imaging and printing, including digital, are also encompassed by the present disclosure. More specifically, the layered photoconductive imaging members disclosed herein can in embodiments be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members disclosed herein are useful in color xerographic applications, particularly high-speed color copying and printing processes.

Illustrated herein are in embodiments photoconductive members comprised of a supporting substrate, an undercoat layer thereover, a photogenerating layer, and a charge transport layer, and wherein the undercoat layer is comprised of a thiophosphate and at least one additional undercoat layer component.

Further illustrated herein are in embodiments photoconductive members comprised of a supporting substrate, an undercoat layer thereover, a photogenerating layer, and a charge transport layer, and wherein the undercoat layer is comprised of a thiophosphate, a metal oxide, and a binder component.

Additionally illustrated herein are in embodiments photoconductive members comprised of a supporting substrate, an undercoat layer thereover, a photogenerating layer, and a charge transport layer, and wherein the undercoat layer is comprised of a thiophosphate, a silane, an optional organometallic compound and an optional binder component.

In various embodiments, the metal oxide may be selected from, for example, ZnO, $SnO_2$, $TiO_2$, $Al_2O_3$, $SiO_2$, $ZrO_2$, $In_2O_3$, $MoO_3$, and a complex oxide thereof, and mixtures and combinations thereof. In various embodiments, the metal oxides have a powder volume resistivity varying from about $10^4$ to about $10^{10}$ Ω cm at a 100 kg/cm$^2$ loading pressure, 50% humidity, and room temperature. In various embodiments, the metal oxides are $TiO_2$. In various embodiments, $TiO_2$ can be either surface treated or untreated. Surface treatments include, but are not limited to aluminum laurate, alumina, zirconia, silica, silane, methicone, dimethicone, sodium metaphosphate, and the like and mixtures thereof. Examples of $TiO_2$ include STR-60N (no surface treatment and powder volume resisitivity of approximately $9\times10^5$ Ω cm) (available from Sakai Chemical Industry Co., Ltd.), FTL-100 (no surface treatment and powder volume resisitivity of approximately $3\times10^5$ Ω cm) (available from Ishihara Sangyo Laisha, Ltd.), STR-60 ($Al_2O_3$ coated and powder volume resisitivity of approximately $4\times10^6$ Ω cm) (available from Sakai Chemical Industry Co., Ltd.), TTO-55N (no surface treatment and powder volume resisitivity of approximately $5\times10^5$ Ω cm) (available from Ishihara Sangyo Laisha, Ltd.), TTO-55A ($Al_2O_3$ coated and powder volume resisitivity of approximately $4\times10^7$ Ω cm) (available from Ishihara Sangyo Laisha, Ltd.), MT-150W (sodium metaphosphate coated and powder volume resisitivity of approximately $4\times10^4$ Ω cm) (available from Tayca), and MT-150AW (no surface treatment and powder volume resisitivity of approximately $1\times10^5$ Ω cm) (available from Tayca). The metal oxide is in embodiments present in an amount of from about 10 to about 90, or from about 30 to about 70 weight percent of the undercoat layer.

In various embodiments, the silane is an aminosilane having the formula

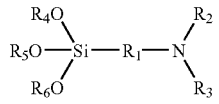

(1)

wherein $R_1$ is an alkylene group containing 1 to 20 carbon atoms, $R_2$ and $R_3$ are independently selected from the group consisting of hydrogen, a lower alkyl group containing 1 to 3 carbon atoms, a phenyl group and a poly(ethylene amino) group, and $R_4$, $R_5$, and $R_6$ are independently selected from a lower alkyl group containing 1 to 4 carbon atoms. Typical aminosilanes include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris (ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilylpropyldiethylene triamine, and the like, and mixtures and combinations thereof. The desired aminosilane materials are 3-aminopropyl triethoxysilane, N-aminoethyl-3-aminopropyl trimethoxysilane, (N,N'-dimethyl-3-amino)propyl triethoxysilane, and the like or mixtures thereof.

The aminosilane may be hydrolyzed with water to form a hydrolyzed silane solution before added into the final undercoat coating solution or dispersion. During hydrolysis of the aminosilanes, the hydrolyzable groups such as alkoxy groups are replaced with hydroxyl groups. It is critical that the pH of the hydrolyzed silane solution be carefully controlled to obtain optimal effects as on curing as well as electrical stability. A solution pH between about 4 and about 10 is desired. Optimal reaction product layers are achieved with hydrolyzed silane solutions having a pH between about 7 and about 8. Control of the pH of the hydrolyzed silane solution may be affected with any suitable organic or inorganic acid. Typical organic and inorganic acids include acetic acid, citric acid, formic acid, hydrogen iodide, phosphoric acid, hydrofluorsilicic acid, p-toluene sulfonic acid and the like. In embodiments, the aminosilane is present in an amount of from about 1 to about 100, or from about 10 to about 99.9 weight percent of the undercoat layer.

In various embodiments, an optional hole blocking layer component comprises an organometallic compound, which can be selected from the group consisting of compounds having the following formulae (2)

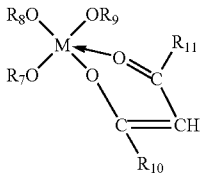

wherein M is a metal atom selected from the group consisting of zirconium and titanium, and $R_7$, $R_8$, and $R_9$ are independently selected from alkyl groups containing one to six carbon atoms and $R_{10}$ and $R_{11}$ are selected from lower alkyl groups containing one to three carbon atoms, and (3)

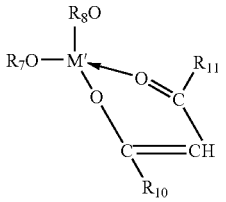

wherein M' is an aluminum atom, $R_7$ and $R_8$ are independently selected from alkyl groups containing one to six carbon atoms and $R_{10}$ and $R_{11}$ are selected from lower alkyl groups containing one to three carbon atoms. Typical organozirconium compounds include monoacetyl acetonate zirconium tributoxide (e.g. ORGATICS ZC-540, available from Matsumoto Kosho Co.), ethyl acetoacetate zirconium trialkoxide, lactic acid zirconium trialkoxide, and the like. Typical organotitanium compounds include monoacetyl acetonate titanium tributoxide, ethyl acetoacetate titanium trialkoxide, lactic acid titanium trialkoxide, and the like. Typical organoaluminum compounds include diisobutyloleyl acetoacetyl aluminate, diisopropyloleyl acetoacetyl aluminate, and the like. In embodiments, the organometallic component can comprise one or mixtures and combinations of these materials. The optional organometallic compound is present in an amount of from about 10 to about 95, or from about 50 to about 85 weight percent of the undercoat layer.

In embodiments, the thiophosphate component comprises a metal free thiophosphate or a metal thiophosphate. For example, in various selected embodiments, the thiophosphate comprises a metal thiophosphate selected from the group consisting of zinc thiophosphate, molybdenum thiophosphate, lead thiophosphate, antimony thiophosphate, manganese thiophosphate, and mixtures and combinations thereof.

In embodiments, the thiophosphate is selected from the group consisting of materials having the following structures (4)

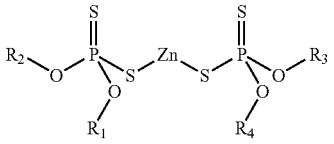

-continued (5)

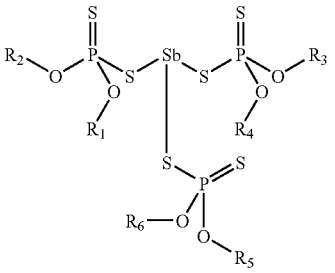

wherein $R_1$, $R_2$, $R_3$, $R_4$, $R_5$ and $R_6$ are each independently selected form the group consisting of hydrogen, an alkyl group having from about 1 to about 20 carbon atoms, a cycloalkyl group having from about 6 to about 26 carbon atoms, aryl, alkylaryl, arylaklyl, or a hydrocarbyl group having form about 3 to about 20 carbon atoms and containing an ester, ether, alcohol or carboxyl group, a straight chained alkyl group having from about 2 to about 18 carbon atoms, a branched alkyl group having from about 2 to about 18 carbon atoms, or mixtures or combinations thereof.

For example, in embodiments, an imaging member is disclosed wherein the thiophosphate comprises metal dialkyldithiophosphate, for example zinc dialkyldithiophosphate. Specific examples of metal dialkyldithiophosphates include molybdenum di(2-ethylhexyl)dithiophosphate, zinc diethyldithiophosphate, antimony diamyldithiophosphate, and the like. Commercial zinc dialkyldithiophosphates include ELCO™ 102, 103, 108, 114, 111, and 121, available from Elco Corporation, Cleveland, Ohio. A number of the thiophosphates contain a certain amount of petroleum distillates, mineral oils such as ValPar™ 500, available from Valero Energy Corporation, San Antonio, Tex. Commercial molybdenum dialkyldithiophosphates include MOLYVAN™ L (molybdenum di(2-ethylhexyl)phosphorodithioate), available from R.T. Vanderbilt Company, Inc., Norwalk, Conn. Commercial antimony dialkyldithiophosphates include VANLUBE™ 622 and 648 (antimony dialkylphosphorodithioate), available from R.T. Vanderbilt Company, Inc., Norwalk, Conn.

Various effective amounts of the thiophosphates, which in embodiments function primarily as permitting excellent photoconductor electricals and ghosting reduction, can be added to the undercoat layer, such as from about 0.01 to about 30 weight percent, or from about 0.1 to about 10 weight percent.

The thiophosphates may also be added to each charge transport layer and/or to the charge generation layer, such as from about 0.01 to about 30 weight percent, from about 0.1 to about 10 weight percent, or from about 0.5 to about 5 weight percent in the charge transport layer or layers; and from about 0.1 to about 40 weight percent, from about 1 to about 20 weight percent, or from about 5 to about 15 weight percent in the charge generation layer. For example, in embodiments, at least one of the charge generation layer and the charge transport layer comprise thiophosphate, and wherein the thiophosphate is present in an amount of from about 0.01 to about 40 weight percent based on the weight of the charge generation layer, the charger transport layer, or a combined weight of the charger generation and charge transport layer.

In embodiments, the undercoat layer may also contain a binder component. Examples of the binder component include, but are not limited to, polyamides, vinyl chlorides, vinyl acetates, phenolic resins, polyurethanes, aminoplasts, melamine resins, benzoguanamine resins, polyimides, polyethylenes, polypropylenes, polycarbonates, polystyrenes, acrylics, styrene acrylic copolymers, methacrylics, vinylidene chlorides, polyvinyl acetals, epoxys, silicones, vinyl chloride-vinyl acetate copolymers, polyvinyl alcohols, polyesters, polyvinyl butyrals, nitrocelluloses, ethyl celluloses, caseins, gelatins, polyglutamic acids, starches, starch acetates, amino starches, polyacrylic acids, polyacrylamides, zirconium chelate compounds, titanyl chelate compounds, titanyl alkoxide compounds, organic titanyl compounds, silane coupling agents, and combinations thereof.

In various embodiments, the binder component comprises a member selected from the group consisting of polyol resins such as phenolic resins, acrylics, styrene acrylics, polyacetals such as polyvinyl butyrals, aminoplast resins such as melamine resins, urea resins, benzoguanamine resins, glycoluril resins, and mixtures and combinations thereof.

In various embodiments, phenolic resins can be considered condensation products of an aldehyde with a phenol source in the presence of an acidic or basic catalyst. The phenol source may be, for example, phenol, alkyl-substituted phenols such as cresols and xylenols, halogen-substituted phenols such as chlorophenol, polyhydric phenols such as resorcinol or pyrocatechol, polycyclic phenols such as naphthol and bisphenol A, aryl-substituted phenols, cyclo-alkyl-substituted phenols, aryloxy-substituted phenols, and combinations thereof. The phenol source may be for example, phenol, 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, p-phenoxy phenol, multiple ring phenols such as bisphenol A, and combinations thereof. The aldehyde may be, for example, formaldehyde, paraformaldehyde, acetaldehyde, butyraldehyde, paraldehyde, glyoxal, furfuraldehyde, propinonaldehyde, benzaldehyde, and combinations thereof. The phenolic resin may be, for example, selected from dicyclopentadiene type phenolic resins, phenol novolak resins, cresol novolak resins, phenol aralkyl resins, and combinations thereof. U.S. Pat. Nos. 6,255,027, 6,177,219, and 6,156,468, incorporated herein by reference in their entireties, disclose examples of photoreceptors containing a hole blocking layer of a plurality of light scattering particles dispersed in a binder. For example, see Example I of U.S. Pat. No. 6,156,468, which discloses a hole blocking layer of titanium dioxide dispersed in a specific linear phenolic binder of VARCUM® (available from OxyChem Company). Examples of phenolic resins include, but are not limited to, formaldehyde polymers with phenol, p-tert-butylphenol, and cresol, such as VARCUM™ 29159 and 29101 (OxyChem Co.) and DURITE™ 97 (Borden Chemical), or formaldehyde polymers with ammonia, cresol, and phenol, such as VARCUM™ 29112 (OxyChem Co.), or formaldehyde polymers with 4,4'-(1-methylethylidene)bisphenol such as VARCUM™ 29108 and 29116 (OxyChem Co.), or formaldehyde polymers with cresol and phenol such as VARCUM™ 29457 (OxyChem Co.), DURITE™ SD-423A, SD-422A (Borden Chemical), or formaldehyde polymers with phenol and p-tert-butylphenol such as DURITE™ ESD 556C (Border Chemical).

The phenolic resins can be used as purchased, or they can be modified to enhance certain properties. For example, the phenolic resins can be modified with suitable plasticizers, including but not limited to polyvinyl butyral, polyvinyl formal, alkyds, epoxy resins, phenoxy resins (bisphenol A, epichlorohydrin polymer) polyamides, oils, and the like.

In various embodiments, examples of acrylic polyol resins or acrylics are copolymers of derivatives of acrylic and methacrylic acid including acrylic and methacrylic esters and compounds containing nitrile and amide groups, and other optional monomers. Styrene acrylic polyol resins or styrene acrylics are copolymers of styrene, derivatives of acrylic and methacrylic acid including acrylic and methacrylic esters and compounds containing nitrile and amide groups, and other optional monomers. Said acrylic esters can be selected from a group consisting of n-alkyl acrylates such as methyl, ethyl, propyl, butyl, pentyl, hexyl, heptyl, octyl, nonyl, decyl, dodecyl, tetradecyl, or hexadecyl acrylate; secondary and branched-chain alkyl acrylates such as isopropyl, isobutyl, sec-butyl, 2-ethylhexyl, or 2-ethylbutyl acrylate; olefinic acrylates such as allyl, 2-methylallyl, furfuryl, or 2-butenyl acrylate; aminoalkyl acrylates such as 2-(dimethylamino)ethyl, 2-(diethylamino)ethyl, 2-(dibutylamino)ethyl, or 3-(diethylamino)propyl acrylate; ether acrylates such as 2-methoxyethyl, 2-ethoxyethyl, tetrahydrofurfuryl, or 2-butoxyethyl acrylate; cycloalkyl acrylates such as cyclohexyl, 4-methylcyclohexyl, or 3,3,5-trimethylcyclohexyl acrylate; halogenated alkyl acrylates such as 2-bromoethyl, 2-chloroethyl, or 2,3-dibromopropyl acrylate; glycol acrylates and diacrylates such as ethylene glycol, propylene glycol, 1,3-propanediol, 1,4-butanediol, diethylene glycol, 1,5-pentanediol, triethylene glycol, dipropylene glycol, 2,5-hexanediol, 2,2-diethyl-1,3-propanediol, 2-ethyl-1,3-hexanediol, or 1,10-decanediol acrylate and diacrylate. Said methacrylic esters can be selected from a group consisting of alkyl methacrylates such as methyl, ethyl, propyl, isopropyl, n-butyl, isobutyl, sec-butyl, t-butyl, n-hexyl, n-octyl, isooctyl, 2-ethylhexyl, n-decyl, or tetradecyl methacrylate; unsaturated alkyl methacrylates such as vinyl, allyl, oleyl, or 2-propynyl methacrylate; cycloalkyl methacrylates such as cyclohexyl, 1-methylcyclohexyl, 3-vinylcyclohexyl, 3,3,5-trimethylcyclohexyl, bornyl, isobornyl, or cyclopenta-2,4-dienyl methacrylate; aryl methacrylates such as phenyl, benzyl, or nonylphenyl methacrylate; hydroxyalkyl methacrylates such as 2-hydroxyethyl, 2-hydroxypropyl, 3-hydroxypropyl, or 3,4-dihydroxybutyl methacrylate; ether methacrylates such as methoxymethyl, ethoxymethyl, 2-ethoxyethoxymethyl, allyloxymethyl, benzyloxymethyl, cyclohexyloxymethyl, 1-ethoxyethyl, 2-ethoxyethyl, 2-butoxyethyl, 1-methyl-(2-vinyloxy)ethyl, methoxymethoxyethyl, methoxyethoxyethyl, vinyloxyethoxyethyl, 1-butoxypropyl, 1-ethoxybutyl, tetrahydrofurftiryl, or furfuryl methacrylate; oxiranyl methacrylates such as glycidyl, 2,3-epoxybutyl, 3,4-epoxybutyl, 2,3-epoxycyclohexyl, or 10,11-epoxyundecyl methacrylate; aminoalkyl methacrylates such as 2-dimethylaminoethyl, 2-diethylaminoethyl, 2-t-octylaminoethyl, N,N-dibutylaminoethyl, 3-diethylaminopropyl, 7-amino-3,4-dimethyloctyl, N-methylformamidoethyl, or 2-ureidoethyl methacrylate; glycol dimethacrylates such as methylene, ethylene glycol, 1,2-propanediol, 1,3-butanediol, 1,4-butanediol, 2,5-dimethyl-1,6-hexanediol, 1,10-decanediol, diethylene glycol, or triethylene glycol dimethacrylate; trimethacrylates such as trimethylolpropane trimethacrylate; carbonyl-containing methacrylates such as carboxymethyl, 2-carboxyethyl, acetonyl, oxazolidinylethyl, N-(2-methacryloyloxyethyl)-2-pyrrolidinone, N-methacryloyl-2-pyrrolidinone, N-(metharyloyloxy)formamide, N-methacryloylmorpholine, or tris(2-methacryloxyethyl)amine methacrylate; other nitrogen-containing methacrylates such as 2-methacryloyloxyethylmethyl cyanamide, methacryloyloxyethyltrimethylammonium chloride, N-(methacryloyloxy-ethyl) diisobutylketimine, cyanomethyl, or 2-cyanoethyl methacrylate; halogenated alkyl methacrylates such as chloromethyl, 1,3-dichloro-2-propyl, 4-bromophenyl, 2-bromoethyl, 2,3-dibromopropyl, or 2-iodoethyl methacrylate; sulfur-containing methacrylates such as methylthiol, butylthiol, ethylsulfonylethyl, ethylsulfinylethyl, thiocyanatomethyl, 4-thiocyanatobutyl, methylsulfinylmethyl, 2-dodecylthioethyl methacrylate, or bis(methacryloyloxyethyl)sulfide; phosphorous-boron-silicon-containing methacrylates such as 2-(ethylenephosphino)propyl, dimethylphosphinomethyl, dimethylphosphonoethyl, diethylphosphatoethyl, 2-(dimethylphosphato)propyl, 2-(dibutylphosphono)ethyl methacrylate, diethyl methacryloylphosphonate, dipropyl methacryloyl phosphate, diethyl methacryloyl phosphite, 2-methacryloyloxyethyl diethyl phosphite, 2,3-butylene methacryloyl-oxyethyl borate, or methyldiethoxymethacryloyloxyethoxysilane. Said methacrylic amides and nitriles can be selected from a group consisting of N-methylmethacrylamide, N-isopropylmethacrylamide, N-phenylmethacrylamide, N-(2-hydroxyethyl)methacrylamide, 1-methacryloylamido-2-methyl-2-propanol, 4-methacryloylamido-4-methyl-2-pentanol, N-(methoxymethyl)methacrylamide, N-(dimethylaminoethyl)methacrylamide, N-(3-dimethylaminopropyl)methacrylamide, N-acetylmethacrylamide, N-methacryloylmaleamic acid, methacryloylamidoacetonitrile, N-(2-cyanoethyl) methacrylamide, 1-methacryloylurea, N-phenyl-N-phenylethylmethacrylamide, N-(3-dibutylaminopropyl)methacrylamide, N,N-diethylmethacrylamide, N-(2-cyanoethyl)-N-methylmethacrylamide, N,N-bis(2-diethylaminoethyl)methacrylamide, N-methyl-N-phenylmethacrylamide, N,N'-methylenebismethacrylamide, N,N'-ethylenebismethacrylamide, or N-(diethylphosphono)methacrylamide. Said other optional monomers can be selected from a group consisting of acrolein, acrylic anhydride, acrylonitrile, acryloyl chloride, methacrolein, methacrylonitrile, methacrylic anhydride, methacrylic acetic anhydride, methacryloyl chloride, methacryloyl bromide, itaconic acid, butadiene, vinyl chloride, vinylidene chloride, or vinyl acetate.

Examples of acrylics include, but are not limited to, PARALOID™ AT-410 (acrylic polyol, 73% in methyl amyl ketone, Tg=30° C., OH equivalent weight=880, acid number=25, Mw=9,000), AT-400 (acrylic polyol, 75% in methyl amyl ketone, Tg=15° C., OH equivalent weight=650, acid number=25, Mw=15,000), AT-746 (acrylic polyol, 50% in xylene, Tg=83° C., OH equivalent weight=1,700, acid number=15, Mw=45,000), and AT-63 (acrylic polyol, 75% in methyl amyl ketone, Tg=25° C., OH equivalent weight=1,300, acid number=30), all available from Rohm and Haas, Philadelphia, Pa. Examples of styrene acrylics include, but not limited to, JONCRYL™ 500 (styrene acrylic polyol, 80% in methyl amyl ketone, Tg=−5° C., OH equivalent weight=400), 550 (styrene acrylic polyol, 62.5% in PM-acetate/toluene=65/35, OH equivalent weight=600), 551 (styrene acrylic polyol, 60% in xylene, OH equivalent weight=600), 580 (styrene acrylic polyol, Tg=50° C., OH equivalent weight=350, acid number=10, Mw=15,000), 942 (styrene acrylic polyol, 73.5% in n-butyl acetate, OH equivalent weight=400), and 945 (styrene acrylic polyol, 78% in n-butyl acetate, OH equivalent weight=310), all available from Johnson Polymer, Sturtevant, Wis.

Acetals, such as polyvinyl butyrals, are formed by the well-known reactions between aldehydes and alcohols. The addition of one molecule of an alcohol to one molecule of an aldehyde produces a hemiacetal. Hemiacetals are rarely isolated because of their inherent instability, but rather are further reacted with another molecule of alcohol to form a stable acetal. Polyvinyl acetals are prepared from aldehydes and polyvinyl alcohols. Polyvinyl alcohols are high molecular weight resins containing various percentages of hydroxyl and acetate groups produced by hydrolysis of polyvinyl acetate. The conditions of the acetal reaction and the concentration of the particular aldehyde and polyvinyl alcohol used are closely controlled to form polymers containing predetermined proportions of hydroxyl groups, acetate groups and acetal groups. The polyvinyl butyral has the formula of (6)

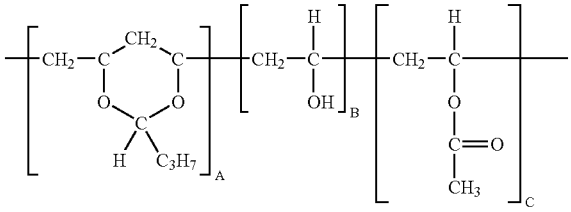

The proportions of polyvinyl butyral (A), polyvinyl alcohol (B) and polyvinyl acetate (C) are controlled, and they are randomly distributed along the molecule. The mole percent of polyvinyl butyral (A) is from about 50 to about 95, that of polyvinyl alcohol (B) is from about 5 to about 30, and that of polyvinyl acetate (C) is from about 0 to about 10. Besides vinyl butyral (A), other vinyl acetals can be optionally present in the molecule including vinyl isobutyral (D), vinyl propyral (E), vinyl acetacetal (F) and vinyl formal (G). The total mole percent of all the monomeric units in one molecule is 100.

Examples of polyvinyl butyrals include Butvar™ B-72 ($M_w$=170,000 to 250,000, A=80, B=17.5 to 20.0, C=0 to 2.5), B-74 ($M_w$=120,000 to 150,000, A=80, B=17.5 to 20.0, C=0 to 2.5), B-76 ($M_w$=90,000 to 120,000, A=88, B=11.0 to 13.0, C=0 to 1.5), B-79 ($M_w$=50,000 to 80,000, A=88, B=10.5 to 13.0, C=0 to 1.5), B-90 ($M_w$=70,000 to 100,000, A=80, B=18.0 to 20.0, C=0 to 1.5), and B-98 ($M_w$=40,000 to 70,000, A=80, B=18.0 to 20.0, C=0 to 2.5), all commercially available from Solutia, St. Louis, Mo.; S-LEC™ BL-1 (degree of polymerization=300, A=63±3, B=37, C=3), BM-1 (degree of polymerization=650, A=65±3, B=32, C=3), BM-S (degree of polymerization=850, A>=70, B=25, C=4 to 6), BX-2 (degree of polymerization=1,700, A=45, B=33, G=20), all commercially available from Sekisui Chemical Co., Ltd., Tokyo, Japan.

In embodiments, aminoplast resin refers to a type of amino resin made from nitrogen-containing substance and formaldehyde, wherein the nitrogen-containing substance includes melamine, urea, benzoguanamine and glycoluril. Also as used herein, melamine resins are amino resins made from melamine and formaldehyde. Melamine resins are known under various trade names, including but not limited to CYMEL™, BEETLE™, DYNOMIN™, BECKAMINE™, UFR™, BAKELITE™, ISOMIN™, MELAICAR™, MELBRITE™, MELMEX™, MELOPAS™, RESART™, and ULTRAPAS™. As used herein, urea resins are amino resins made from urea and formaldehyde. Urea resins are known under various trade names, including but not limited to CYMEL™, BEETLE™, UFRM , DYNOMIN™, BECKAMINE™, and AMIREME™. As used herein, benzoguanamine resins are amino resins made from benzoguanamine and formaldehyde. Benzoguanamine resins are known under various trade names, including but not limited to CYMEL™, BEETLE™, and UFORMITE™. As used herein, glycoluril resins are amino resins made from glycoluril and formaldehyde. Glycoluril resins are known under various trade names, including but not limited to CYMEL™, and POWDERLINK™. The aminoplast resins can be highly alkylated or partially alkylated.

In embodiments, the melamine resin selected has a generic formula of (7)

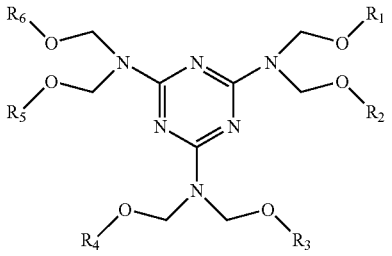

wherein $R_1$, $R_2$, $R_3$, $R_4$, $R_5$ and $R_6$ each independently represents a hydrogen atom or an alkyl chain with 1 to 8 carbon atoms, or with 1 to 4 carbon atoms.

The melamine resin is in embodiments water-soluble, dispersible or non dispersible. In various embodiments, the melamine resin can be highly alkylated/alkoxylated, partially alkylated/alkoxylated, or mixed alkylatedlalkoxylated. In various embodiments, the melamine resin can be methylated, n-butylated or isobutylated. Examples of the melamine resin include highly methylated melamine resins such as CYMEL™ 350, 9370; methylated high imino melamine resins (partially methylolated and highly alkylated) such as CYMEL™ 323, 327; partially methylated melamine resins (highly methylolated and partially methylated) such as CYMEL™ 373, 370; high solids mixed ether melamine resins such as CYMEL™ 1130, 324; n-butylated melamine resins such as CYMEL™ 1151, 615; n-butylated high imino melamine resins such as CYMEL™ 1158; iso-butylated melamine resins such as CYMEL™255-10. CYMEL™ melamine resins are commercially available from CYTEC.

Specific examples of melamine resin are methylated formaldehyde-melamine resin, methoxymethylated melamine resin, ethoxymethylated melamine resin, propoxymethylated melamine resin, butoxymethylated melamine resin, hexamethylol melamine resin, alkoxyalkylated melamine resins such as methoxymethylated melamine resin, ethoxymethylated melamine resin, propoxymethylated melamine resin, butoxymethylated melamine resin, and mixtures thereof.

In embodiments, the urea resin selected is of the formula (8)

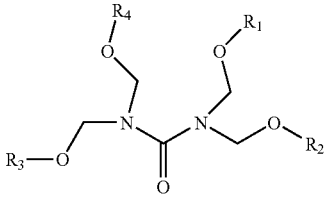

wherein $R_1$, $R_2$, $R_3$, and $R_4$ each independently represents a hydrogen atom or an alkyl chain with for example 1 to about 8 carbon atoms, or with 1 to about 4 carbon atoms.

The urea resin in embodiments is water-soluble, dispersible or indispersible. In various embodiments, the urea resin can be highly alkylated/alkoxylated, partially alkylated/alkoxylated, or mixed alkylated/alkoxylated. In various embodiments, the urea resin can be methylated, n-butylated or isobutylated. Examples of the urea resin include methylated urea resins such as CYMEL™ U-65, U-382; n-butylated urea resins such as CYMEL™ U-1054, UB-30-B; isobutylated urea resins such as CYMEL™ U-662, UI-19-I. CYMEL™ urea resins are commercially available from CYTEC.

The benzoguanamine resin selected is of the general formula (9)

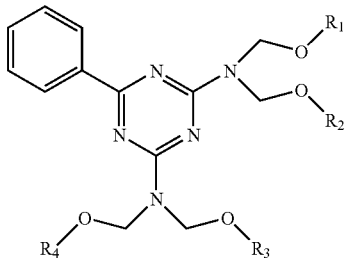

wherein $R_1$, $R_2$, $R_3$, and $R_4$ each independently represents a hydrogen atom or an alkyl chain with for example 1 to about 8 carbon atoms, or with 1 to about 4 carbon atoms.

In embodiments, the benzoguanamine resin is water-soluble, dispersible or indispersible; thus, the benzoguanamine resin can be highly alkylated/alkoxylated, partially alkylated/alkoxylated, or mixed alkylated/alkoxylated. In various embodiments, the benzoguanamine resin can be methylated, n-butylated or isobutylated. Examples of the benzoguanamine resin include CYMEL™ 659, 5010, 5011. CYMEL™ benzoguanamine resins are commercially available from CYTEC.

The glycoluril resin selected is of the generic formula (10)

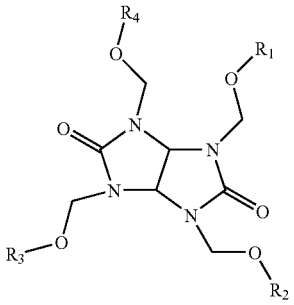

wherein $R_1$, $R_2$, $R_3$, and $R_4$ each independently represents a hydrogen atom or an alkyl chain with 1 to about 8 carbon atoms, or with 1 to about 4 carbon atoms.

Also, the glycoluril resin is water-soluble, dispersible or indispersible. In various embodiments, the glycoluril resin can be highly alkylated/alkoxylated, partially alkylated/alkoxylated, or mixed alkylated/alkoxylated. In various embodiments, the glycoluril resin can be methylated, n-butylated or isobutylated. Examples of the glycoluril resin include CYMEL™ 1170, 1171. CYMEL™ glycoluril resins are commercially available from CYTEC.

In embodiments, the one or more additional undercoat layer components is a binder component present in an amount of from about 1 to about 80 weight percent, or from about 1 to about 50 weight percent based on the weight of the undercoat layer.

For example, in embodiments, a member includes a supporting substrate, an undercoat layer thereover, a photogenerating layer, and a charge transport layer, and wherein the undercoat layer is comprised of a thiophosphate, a metal oxide and a binder component. In embodiments, a photoconductive member comprised in sequence of an optional supporting substrate, an undercoat layer thereover, a photogenerating layer, and a charge transport layer, and wherein the undercoat layer is comprised of a zinc dialkylthiophosphate, a titanium dioxide, and a binder component. In embodiments, a photoconductive member comprised in sequence of an optional supporting substrate, an undercoat layer thereover, a photogenerating layer, and a charge transport layer, and wherein the undercoat layer is comprised of a zinc dialkyldithiophosphate, a titanium dioxide, a phenolic resin and a melamine resin.

For another example, in embodiments, a member includes a supporting substrate, an undercoat layer thereover, a photogenerating layer, and a charge transport layer, and wherein the undercoat layer is comprised of a thiophosphate, a silane, an optional organometallic compound and a binder component. In embodiments, a photoconductive member comprised in sequence of an optional supporting substrate, an undercoat layer thereover, a photogenerating layer, and a charge transport layer, and wherein the undercoat layer is comprised of a zinc dialkyldithiophosphate, and an aminosilane. In embodiments, a photoconductive member comprised in sequence of an optional supporting substrate, an undercoat layer thereover, a photogenerating layer, and a charge transport layer, and wherein the undercoat layer is comprised of a zinc dialkyldithiophosphate, an aminosilane, an organic zirconate, and a polyvinyl butyral.

Further disclosed herein, in embodiments, is a photoconductive imaging member comprised of a supporting substrate, an undercoat layer thereover, a photogenerating layer and a charge transport layer, and wherein the undercoat layer is comprised of, for example, a mixture of a thiophosphate such as for example zinc dialkylthiophosphate, a metal oxide such as for example $TiO_2$, and a polymeric binder, and optionally an electron transport component of, for example, N,N'-bis(1,2-dimethylpropyl)-1,4,5,8-naphthalenetetracarboxylic diimide; N,N'-bis(1,2-dimethylpropyl)-1,4,5,8-naphthalene tetracarboxylic acid; bis(2-heptylimido)perinone; butoxy carbonyl fluorenylidene malononitrile (BCFM); benzophenone bisimide; or a substituted carboxybenzylnaphthaquinone.

In embodiments, the undercoat layer may contain an optional light scattering particle. In various embodiments, the light scattering particle has a refractive index different from the binder and has a number average particle size greater than about 0.8 μm. In various embodiments, the light scattering particle is amorphous silica P-100 commercially available from Espirit Chemical Co. In various embodiments, the light scattering particle is present in an amount of about 0% to about 10% by weight of a total weight of the undercoat layer.

In embodiments, the undercoat layer may contain various colorants. In various embodiments, the undercoat layer may contain organic pigments and organic dyes, including, but not limited to, azo pigments, quinoline pigments, perylene pigments, indigo pigments, thioindigo pigments, bisbenzimidazole pigments, phthalocyanine pigments, quinacridone pigments, quinoline pigments, lake pigments, azo lake pigments, anthraquinone pigments, oxazine pigments, dioxazine pigments, triphenylmethane pigments, azulenium dyes, squalium dyes, pyrylium dyes, triallylmethane dyes, xanthene dyes, thiazine dyes, and cyanine dyes. In various embodiments, the undercoat layer may include inorganic materials, such as amorphous silicon, amorphous selenium, tellurium, a selenium-tellurium alloy, cadmium sulfide, antimony sulfide, titanium oxide, tin oxide, zinc oxide, and zinc sulfide, and combinations thereof.

In embodiments, the thickness of the undercoat layer is from about 0.01 micrometers (μm) to 30 μm, or from about 0.1 μm to 15 μm, or from about 1 μm to 10 μm. In embodiments, electrophotographic imaging members contain undercoat layer s having a thickness of from about 0.01 μm to 30 μm, or from about 0.1 μm to 15 μm, or from about 1 μm to 10 μm.

A photoconductive imaging member herein can comprise in embodiments in sequence of a supporting substrate, an undercoat layer, an adhesive layer, a photogenerating layer and a charge transport layer. For example, the adhesive layer can comprise a polyester with, for example, an $M_w$ of about 70,000, and an $M_n$ of about 35,000.

In embodiment, the supporting substrate can be selected from a conductive metal substrate; an aluminum, aluminized polyethylene terephthalate or titanized polyethylene.

In embodiments, the photogenerating layer is selected at a thickness of from about 0.05 to about 12 microns.

In embodiments, the charge transport layer, such as a hole transport layer, is selected at a thickness of from about 10 to about 55 microns.

Photogenerating pigments can be selected for the photogenerating layer in embodiments for example of an amount of from about 10 percent by weight to about 95 percent by weight dispersed in a resinous binder.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments electrically inactive binders are comprised of polycarbonate resins with for example a molecular weight of from about 20,000 to about 100,000 and more specifically with a molecular weight $M_w$ of from about 50,000 to about 100,000. Examples of polycarbonates are poly(4,4'-isopropylidene-diphenylene)carbonate (also referred to as bisphenol-A-polycarbonate, poly(4,4'-cyclohexylidinediphenylene)carbonate (referred to as bisphenol-Z polycarbonate), poly(4,4'-isopropylidene-3,3'-dimethyldiphenyl)carbonate (also referred to as bisphenol-C-polycarbonate) and the like.

The charge transport layers can comprise in embodiments aryl amine molecules, and other known charge, especially hole transports. For example; a photoconductive imaging member herein wherein the charge transport aryl amines are of the formula (11)

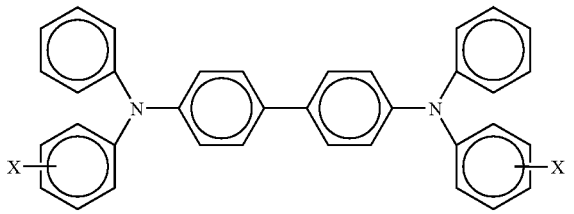

wherein X is alkyl, and wherein the aryl amine is dispersed in a resinous binder; a photoconductive imaging member wherein for the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methylphenyl)-1,1'-biphenyl-4,4'-diamine.

The charge transport aryl amines can also be of the formula (12)

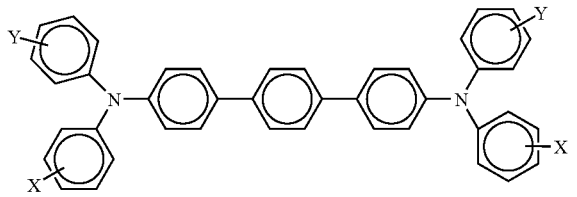

wherein X and Y are independently alkyl, alkoxy, aryl, a halogen, or mixtures thereof. Alkyl and alkoxy can contain for example from 1 to about 25 carbon atoms, and more specifically from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substitutent is a chloro substitutent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine and the like and optionally mixtures thereof. Other known charge transport layer molecules can be selected, reference for example, U.S. Pat. Nos. 4,921,773 and 4,464,450, the disclosures of which are totally incorporated herein by reference. In embodiments, therefore, the charge transport layer comprises aryl amine mixtures.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX 1010™, available from Ciba Specialty Chemical), butylated hydroxytoluene (BHF), and other hindered phenolic antioxidants including SUMILIZER BHT-R™, MDP-S™, BBM-S™, WX-R™, NW™, BP-76™, BP-101™, GA-80™, GM™ and GS™ (available from Sumitomo Chemical Co., Ltd.), IRGANOX 1035™, 1076™, 1098™, 1135™, 1141™, 1222™, 1330™, 1425WL™, 1520L™, 245™, 259™, 3114™, 3790™, 5057™ and 565™ (available from Ciba Specialties Chemicals), and ADEKA STAB AO-20™, AO-30™, AO40™, AO-50™, AO-60™, AO-70™, AO-80™ and AO-330™ (available from Asahi Denka Co., Ltd.); hindered amine antioxidants such as SANOL LS-2626™, LS-765™, LS-770™ and LS-744™ (available from SNKYO CO., Ltd.), TINUVIN 144™ and 622LD™ (available from Ciba Specialties Chemicals), MARK LA57™, LA67™, LA62™, LA68™ and LA63™ (available from Asahi Denka Co., Ltd.), and SUMILIZER TPS™ (available from Sumitomo Chemical Co., Ltd.); thioether antioxidants such as SUMILIZER TP-D™ (available from Sumitomo Chemical Co., Ltd); phosphite antioxidants such as MARK 2112™, PEP-8™, PEP-24G™, PEP-36™, 329K™ and HP-10™ (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

An adhesive layer may optionally be applied such as to the hole blocking layer. The adhesive layer may comprise any suitable material, for example, any suitable film forming polymer. Typical adhesive layer materials include, but are not limited to, for example, copolyester resins, polyarylates, polyurethanes, blends of resins, and the like. Any suitable solvent may be selected in embodiments to form an adhesive layer coating solution. Typical solvents include, but are not limited to, for example, tetrahydrofuran, toluene, hexane, cyclohexane, cyclohexanone, methylene chloride, 1,1,2-trichloroethane, monochlorobenzene, and mixtures thereof, and the like.

In embodiments, a photoconductive imaging member further includes an adhesive layer of a polyester with an $M_w$ of about 75,000, and an $M_n$ of about 40,000.

The photogenerating layer is comprised in embodiments of metal phthalocyanines, metal free phthalocyanines, perylenes, hydroxygallium phthalocyanines, chlorogallium phthalocyanines, titanyl phthalocyanines, vanadyl phthalocyanines, selenium, selenium alloys, trigonal selenium, and the like, and mixtures and combinations thereof; a photoconductive imaging member wherein the photogenerating layer is comprised of titanyl phthalocyanines, perylenes, bis(benzimidazo)perylene, or hydroxygallium phthalocyanines, and mixtures and combinations thereof; a photoconductive imaging member wherein the photogenerating layer is comprised of Type V hydroxygallium phthalocyanine.

The undercoat layer can in embodiments be prepared by a number of known methods; the process parameters being dependent, for example, on the member desired. The undercoat layer can be coated as solution or a dispersion onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 1 minute to about 10 hours, under stationary conditions or in an air flow. The coating can be accomplished to provide a final coating thickness of in embodiments from about 0.01 to about 30 or about 1 to about 10 micrometers after drying.

Illustrative examples of substrate layers selected for the imaging members of the present disclosure can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®. Moreover, the substrate may contain thereover an undercoat layer, including known undercoat layers, such as suitable phenolic resins, phenolic compounds, mixtures of phenolic resins and phenolic compounds, titanium oxide, silicon oxide mixtures like $TiO_2/SiO_2$.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

The photogenerating layer, which can be comprised of the components indicated herein, such as hydroxychlorogallium phthalocyanine, is in embodiments comprised of, for example, about 50 weight percent of the hyroxygallium or other suitable photogenerating pigment, and about 50 weight percent of a resin binder like polystyrene/polyvinylpyridine. The photogenerating layer can contain known photogenerating pigments, such as metal phthalocyanines, metal free phthalocyanines, hydroxygallium phthalocyanines, perylenes, especially bis(benzimidazo)perylene, titanyl phthalocyanines, and the like, and more specifically, vanadyl phthalocyanines, Type V chlorohydroxygallium phthalocyanines, and inorganic components, such as selenium, especially trigonal selenium. The photogenerating pigment can be dispersed in a resin binder similar to the resin binders selected for the charge transport layer, or alternatively no resin binder is needed. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 15 microns, or from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50 or from about 1 to about 10 weight percent, may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. It is desirable to select a coating solvent that does not substantially disturb or adversely affect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerating layers in embodiments of the present disclosure can be accomplished with spray, dip or wire-bar methods such that the final dry thickness of the photogenerator layer is, for example, from about 0.01 to about 30 microns or from about 0.1 to about 15 microns after being dried at, for example, about 40° C. to about 150° C. for about 1 to about 90 minutes.

Illustrative examples of polymeric binder materials that can be selected for the photogenerating layer are as indicated herein, and include those polymers as disclosed in U.S. Pat. No. 3,121,006, the disclosure of which is totally incorporated herein by reference; phenolic resins as illustrated in the appropriate copending applications recited herein, the disclosures of which are totally incorporated herein by reference. In general, the effective amount of polymer binder that is utilized in the photogenerating layer ranges from about 0 to about 95 percent by weight, or from about 25 to about 60 percent by weight of the photogenerating layer.

As optional adhesive layers usually in contact with the undercoat layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 3 microns or about 1 micron. Optionally, this layer may contain effective suitable amounts, for example from about 1 to about 10 weight percent, conductive and nonconductive particles, such as zinc oxide, titanium dioxide, silicon nitride, carbon black, and the like, to provide, for example, in embodiments herein further desirable electrical and optical properties.

Various suitable known charge transport compounds, molecules and the like can be selected for the charge transport layer, such as aryl amines of the following formula (13)

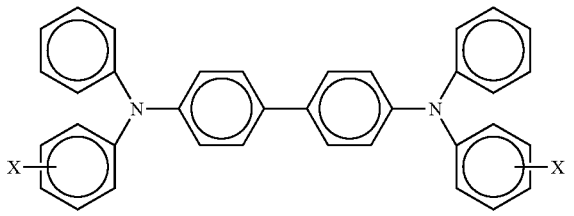

wherein a thickness thereof is, for example, from about 5 microns to about 75 microns or from about 10 microns to about 40 microns dispersed in a polymer binder, wherein X is selected from the group consisting of alkyl, alkoxy, aryl and halogen, and the alkyl contains for example from about 1 to about 10 carbon atoms, or mixtures thereof, for example, in embodiments, substitutents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis (halophenyl)-1,1'-biphenyl-4,4'-diamine wherein the halo substitutent is in embodiments a chloro substitutent. Other known charge transport layer molecules can be selected, reference for example U.S. Pat. Nos. 4,921,773 and 4,464,450, the disclosures of which are totally incorporated herein by reference.

The charge transport aryl amines can also be of the formula (14)

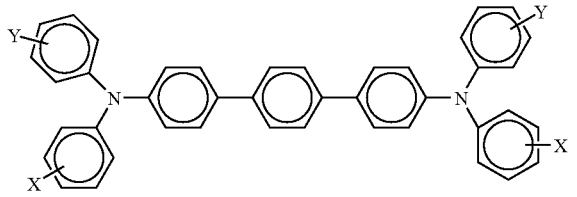

wherein X and Y are independently alkyl, alkoxy, aryl, a halogen, or mixtures thereof. Alkyl and alkoxy contain for example from 1 to about 25 carbon atoms, and more specifically from 1 to about 10 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

In embodiments, the charge transport layer comprises aryl amine mixtures. Examples of specific aryl amines aryl amine molecules selected herein include but are not limited to aryl amines selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, and mixtures and combinations thereof.

In embodiments, the at least one charge transport layer comprises an antioxidant optionally comprised of, for example, a hindered phenol or a hindered amine.

Examples of binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies, and block, random or alternating copolymers thereof. In embodiments, electrically inactive binders are selected comprised of polycarbonate resins having a molecular weight of from about 20,000 to about 100,000 or from about 50,000 to about 100,000. Generally, the transport layer contains from about 10 to about 75 percent by weight of the charge transport material or from about 35 percent to about 50 percent of this material.

In embodiments, the at least one charge transport layer comprises from about 1 to about 7 layers. For example, in embodiments, the at least one charge transport layer comprises a top charge transport layer and a bottom charge transport layer, wherein the bottom layer is situated between the charge generation layer and the top layer.

Also, included herein are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

Various exemplary embodiments encompassed herein include a method of imaging which includes generating an electrostatic latent image on an imaging member, developing a latent image, and transferring the developed electrostatic image to a suitable substrate.

Various exemplary embodiments include methods including forming an electrostatic latent image on an imaging member; developing the image with a toner composition including, for example, at least one thermoplastic resin, at least one colorant, such as pigment, at least one charge additive, and at least one surface additive; transferring the image to a necessary member, such as, for example any suitable substrate, such as, for example, paper; and permanently affixing the image thereto. In various exemplary embodiments in which the embodiment is used in a printing mode, various exemplary imaging methods include forming an electrostatic latent image on an imaging member by use of a laser device or image bar; developing the image with a toner composition including, for example, at least one thermoplastic resin, at least one colorant, such as pigment, at least one charge additive, and at least one surface additive; transferring the image to a necessary member, such as, for example any suitable substrate, such as, for example, paper; and permanently affixing the image thereto.

In a selected embodiment, an image forming apparatus for forming images on a recording medium comprises a) a photoreceptor member having a charge retentive surface to receive an electrostatic latent image thereon, wherein said photoreceptor member comprises a metal or metallized substrate, an undercoat layer comprising a thiophosphate and optionally one or more additional undercoat layer components; a charge generation layer comprising photoconductive pigment, and a charge transport layer comprising charge transport materials dispersed therein; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Illustrative photoresponsive imaging members were fabricated as follows. Multilayered photoreceptors of the rigid drum design were fabricated by conventional coating technology with an aluminum drum of 34 millimeters in diameter as the substrate. All the photoreceptors contained the same charge generation layer and charge transport layer. The difference is that Comparative Example 1 and 2 contained no thiophosphate additive in the undercoat layer. Reference commonly assigned, copending U.S. patent application Ser. No. 11/481,729, which is hereby incorporated by reference herein in it entirety, describing a charge generation layer dispersion comprising thiophosphate. Comparative Example 1 was prepared comprising an undercoat layer (UCL) comprising a phenolic resin, a melamine resin, and titanium oxide; Comparative Example 2 was prepared comprising an undercoat layer (UCL) comprising an aminosilane, an organic zirconate and a polyvinyl butyral. Example 1 contained the same layers as Comparative Example 1 except that zinc dialkyldithiophosphate (ZDDP) was incorporated into the UCL; Example 2 contains the same layers as Comparative Example 2 except that zinc dialkylthiophosphate (ZDDP) is incorporated into the UCL. Multilayered photoreceptors of the flexible belt design were fabricated by conventional coating technology with a biaxially oriented polyethylene naphthalate substrate (KALEDEX™ 2000) having a thickness of 3.5 mils as the substrate. All the photoreceptors contained the same adhesive layer, charge generation layer and charge transport layers. The difference is that Comparative Example 3 contained no thiophosphate additive in the undercoat layer. Comparative Example 3 was prepared comprising an undercoat layer (UCL) comprising an aminosilane. Example 3 contains the same layers as Comparative Example 3 except that zinc dialkylthiophosphate (ZDDP) is incorporated into the UCL.

Comparative Example 1

The undercoat layer was prepared as follows: a titanium oxide/phenolic resin/melamine resin dispersion was prepared by ball milling 60 grams of titanium dioxide (MT-150W, Tayca Company), 12 grams of the phenolic resin (VARCUM™ 29159, OxyChem Company, $M_w$ of about 3,600, viscosity of about 200 cps) and 28 grams of the melamine resin (CYMEL™ 323, CYTEC) in 7.5 grams of 1-butanol, and 7.5 grams of xylene with 120 grams of 1 millimeter diameter sized $ZrO_2$ beads for 5 days. The resulting titanium dioxide dispersion was filtered with a 20 micrometer pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/VARCUM™/CYMEL™ dispersion. Then an aluminum drum, cleaned with detergent and rinsed with deionized water, was coated with the above generated coating dispersion, and subsequently, dried at 150° C. for 40 minutes, which resulted in an undercoat layer deposited on the aluminum and comprised of $TiO_2$/VARCUM™/CYMEL™ with a weight ratio of about 60/12/28 and a thickness of 4 μm.

The charge generation layer was prepared as follows: 54 grams of Type B chlorogallium phthalocyanine (ClGaPc) pigment was mixed with about 46 grams of polymeric binder VMCH (Dow Chemical), 30 grams of xylene and 15 grams of n-butyl acetate. The mixture was milled in an ATTRITOR mill with about 200 grams of 1 mm Hi-Bea borosilicate glass beads for about 3 hours. The dispersion was filtered through a 20-μm nylon cloth filter, and the solid content of the dispersion was diluted to about 5.8 weight percent with a mixture of xylene/n-butyl acetate=2/1 (weight/weight). The ClGaPc charge generation layer dispersion was applied on top of the above undercoat layer. The thickness of the charge generation layer was approximately 0.2 μm.

Subsequently, a 30-μm charge transport layer was coated on top of the charge generation layer, respectively, which coating dispersion was prepared as follows: N,N'-diphenyl-N,N-bis(3-methylphenyl)-1,1'-biphenyl-4,4'-diamine (43 grams), a film forming polymer binder PCZ 400 [poly(4,4'-dihydroxy-diphenyl-1-1-cyclohexane, $M_w$=40,000)] available from Mitsubishi Gas Chemical Company, Ltd. (57 grams), and PTFE POLYFLON L-2 microparticle (8 grams) available from Daikin Industries were dissolved/dispersed in a solvent mixture of 20 grams of tetrahydrofuran (THF) and 6.7 grams of toluene via CAVIPRO 300 nanomizer (Five Star technology, Cleveland, Ohio). The charge transport layer was dried at about 120° C. for about 40 minutes.

Example 1

An imaging member was prepared as in Comparative Example 1 except that 5 grams of zinc dialkyldithiophosphate (ZDDP ELCO™ 103, wherein alkyl is mixture of primary and secondary propyl, butyl and pentyl), commercially available from Elco Corporation was added into the undercoat layer dispersion, and the resulting dispersion was allowed to mix for at least two hours before coating.

Comparative Example 2

The undercoat layer was prepared as follows: zirconium acetylacetonate tributoxide (ORGATICS™ ZC-540, available from Matsumoto Kosho Co., Japan, 35.5 grams), γ-aminopropyltriethoxysilane (4.8 grams) and polyvinyl butyral S-LEC™ BM-S (degree of polymerization=850, mole percent of vinyl butyral>=70, mole percent of vinyl acetate=4 to 6, mole percent of vinyl alcohol=25, available from Sekisui Chemical Co., Ltd., Tokyo, Japan, 2.5 grams) was dissolved in n-butanol (52.2 grams). The coating solution was coated via a ring coater, and the layer was pre-heated at 59° C. for 13 minutes, humidified at 58° C. (dew point=54° C.) for 17 minutes, and dried at 135° C. for 8 minutes. The thickness of the undercoat layer was approximately 1.3 μm.

The charge generation layer was prepared as follows: 54 grams of Type B chlorogallium phthalocyanine (ClGaPc) pigment was mixed with about 46 grams of polymeric binder VMCH (Dow Chemical), 30 grams of xylene and 15 grams of n-butyl acetate and 46 grams zinc dialkylthiophosphate. The mixture was milled in an ATTRITOR mill with about 200 grams of 1 mm Hi-Bea borosilicate glass beads for about 3 hours. The dispersion was filtered through a 20-μm nylon cloth filter, and the solid content of the dispersion was diluted to about 5.8 weight percent with a mixture of xylene/n-butyl acetate=2/1 (weight/weight). The ClGaPc charge generation layer dispersion was applied on top of the above undercoat layer. The thickness of the charge generation layer was approximately 0.2 μm.

Subsequently, a 30-μm charge transport layer was coated on top of the charge generation layer, respectively, which coating dispersion was prepared as follows: N,N'-diphenyl-N,N-bis(3-methylphenyl)-1,1'-biphenyl-4,4'-diamine (43 grams), a film forming polymer binder PCZ 400 [poly(4,4'-dihydroxy-diphenyl-1-1-cyclohexane, $M_w$=40,000)] available from Mitsubishi Gas Chemical Company, Ltd. (57 grams), and PTFE POLYFLON L-2 microparticle (8 grams) available from Daikin Industries were dissolved/dispersed in a solvent mixture of 20 grams of tetrahydrofuran (THF) and 6.7 grams of toluene via CAVIPRO 300 nanomizer (Five Star technology, Cleveland, Ohio). The charge transport layer was dried at about 120° C. for about 40 minutes.

Example 2

An imaging member is prepared as in Comparative Example 2 except that 0.4 grams of zinc dialkyldithiophosphate (ZDDP ELCO™ 103, wherein alkyl is mixture of primary and secondary propyl, butyl and pentyl), commercially available from Elco Corporation is added into the undercoat layer solution, and the resulting solution is allowed to mix for at least two hours before coating.

Comparative Example 3

An imaging member was prepared by providing a 0.02 micrometer thick titanium layer coated (the coater device) on a biaxially oriented polyethylene naphthalate substrate (KALEDEX™ 2000) having a thickness of 3.5 mils, and applying thereon, with a gravure applicator, an undercoat layer solution containing 50 grams of 3-amino-propyltriethoxysilane, 41.2 grams of water, 15 grams of acetic acid, 684.8 grams of denatured alcohol, and 200 grams of heptane. This layer was then dried for about 1 minute at 120° C. in the forced air dryer of the coater. The resulting undercoat layer had a dry thickness of 500 Angstroms. An adhesive layer was then prepared by applying a wet coating over the blocking layer, using a gravure applicator, and which adhesive contains 0.2 percent by weight based on the total weight of the solution of copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A charge generation layer dispersion was prepared by introducing 0.45 grams of the known polycarbonate LUPILON 200™ (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛-inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a charge generation layer having a wet thickness of 0.25 mil. A strip about 10 millimeters wide along one edge of the substrate web bearing the undercoat layer and the adhesive layer was deliberately left uncoated by any of the charge generation layer material to facilitate adequate electrical contact by the ground strip layer that was applied later. The charge generation layer was dried at 120° C. for 1 minutes in a forced air oven to form a dry charge generation layer having a thickness of 0.4 micrometer.

The resulting imaging member web was then overcoated with a two-layer charge transport layer. Specifically, the charge generation layer was overcoated with a charge transport layer (the bottom layer) in contact with the charge generation layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON 5705®, a known polycarbonate resin having a molecular weight average of from about 50,000 to 100,000, commercially available from Farbenfabriken Bayer A.G. The resulting mixture was then dissolved in methylene chloride to form a solution containing 15 percent by weight solids. This solution was applied on the charge generation layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process the humidity was equal to or less than 15 percent.

Example 3

An imaging member is prepared as in Comparative Example 3 except that 0.05 grams of zinc dialkyldithiophosphate (ZDDP ELCO™ 103, wherein alkyl is mixture of primary and secondary propyl, butyl and pentyl), commercially available from Elco Corporation is added into the undercoat layer solution, and the resulting solution is allowed to mix for at least two hours before coating.

The first two photoreceptor devices (Comparative Example 1 and Example 1) were tested in a scanner set to obtain photo-induced discharge cycles, sequenced at one charge-erase cycle followed by one charge-expose-erase cycle, wherein the light intensity was incrementally increased with cycling to produce a series of photo-induced discharge characteristic curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of 700 volts with the exposure light intensity incrementally increased by means of regulating a series of neutral density filters; the exposure light source was a 780-nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Two photo-induced discharge characteristic (PIDC) curves were generated. The PIDC results are summarized in Table 1. Incorporation of thiophosphate into undercoat layer increased ClGaPc photosensitivity (initial slope of the PIDC) by about 20%, and decreased V(2.8 ergs/cm$^2$), which represents the surface potential of the device when exposure is 2.8 ergs/cm$^2$, about 100V.

The devices were acclimated for 24 hours before testing in J zone (70° F. and 10% humidity) for ghosting test. Print test was done in Copeland Work centre Pro 3545 using K station at t=500 print counts. Run-up from t=0 to t=500 print counts for the device was done in one of the CYM color stations. Ghosting levels were measured against TSIDU SIR scale (from Grade 1 to Grade 6). The smaller the ghosting grade (absolute value), the better the print quality. The ghosting results are also summarized in Table 1, and negative ghosting grades indicate negative ghosting. Incorporation of thiophosphate into undercoat layer reduced ghosting by about two grades.

TABLE 1

| | Sensitivity ($Vcm^2/erg$) | V (2.8 $ergs/cm^2$) (V) | J zone ghosting (t = 500 prints) |
|---|---|---|---|
| Comparative Example 1 | −200 | 260 | −5 |
| Example 1 | −240 | 160 | −3 |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. An imaging member comprising:

a substrate;

a charge generation layer positioned on the substrate;

at least one charge transport layer positioned on the charge generation layer; and an undercoat layer positioned on the substrate on a side opposite the charge generation layer, the undercoat layer comprising a thiophosphate, and optionally one or more additional undercoat layer components.

2. An imaging member of claim 1, wherein the one or more additional undercoat layer components are selected from the group consisting of binder components, metal oxides, silanes, organometallic compounds, and mixtures and combinations thereof.

3. The imaging member of claim 1, wherein the one or more additional undercoat layer components comprise a metal oxide and a binder component.

4. The imaging member of claim 1, wherein the one or more additional undercoat layer components comprise a silane, an optional organometallic compound, and an optional binder component.

5. The imaging member of claim 1, wherein the undercoat layer is of a thickness of from about 0.01 to about 30 micrometers.

6. The imaging member of claim 2, wherein the binder component comprises a member selected from the group consisting of polyol resins, aminoplast resins, polyacetal resins, phenolic resins, melamine resins, urea resins, benzoguanamine resins, glycoluril resins, acrylics, styrene acrylics, polyvinyl butyrals and mixtures and combinations thereof.

7. The imaging member of claim 1, wherein the one or more additional undercoat layer components is a binder component present in an amount of from about 1 to about 80 weight percent based upon the weight of the undercoat layer.

8. The imaging member of claim 2, wherein the metal oxide comprises a member selected from the group consisting of ZnO, $SnO_2$, $TiO_2$, $Al_2O_3$, $SiO_2$, $ZrO_2$, $In_2O_3$, $MoO_3$ and mixtures and combinations thereof.

9. The imaging member of claim 2, wherein the metal oxide is present in an amount of from about 10 to about 90 weight percent of the undercoat layer.

10. The imaging member of claim 2, wherein the silane is an aminosilane having the formula of

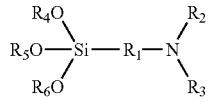

(1)

wherein $R_1$ is an alkylene group containing 1 to 20 carbon atoms, $R_2$ and $R_3$ are independently selected from the group consisting of hydrogen, a lower alkyl group containing 1 to 3 carbon atoms, a phenyl group and a poly(ethylene amino) group, and $R_4$, $R_5$, and $R_6$ are independently selected from a lower alkyl group containing 1 to 4 carbon atoms.

11. The imaging member of claim 2, wherein the silane is selected from a group consisting of 3 aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilylpropyldiethylene triamine and mixtures and combinations thereof.

12. The imaging member of claim 2, wherein the silane is present in an amount of from about 1 to about 100 weight percent of the undercoat layer.

13. The imaging member of claim 2, wherein the organometallic compound is selected from the group consisting of compounds having the following formulae

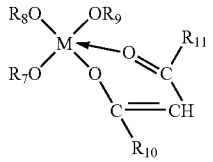

(2)

wherein M is a metal atom selected from the group consisting of zirconium and titanium, and $R_7$, $R_8$, and $R_9$ are independently selected from alkyl groups containing one to six carbon atoms and $R_{10}$ and $R_{11}$ are selected from lower alkyl groups containing one to three carbon atoms, and

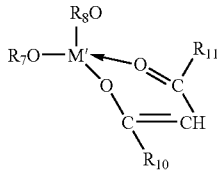

(3)

wherein M' is an aluminum atom, $R_7$ and $R_8$ are independently selected from alkyl groups containing one to six carbon atoms and $R_{10}$ and $R_{11}$ are selected from lower alkyl groups containing one to three carbon atoms.

14. The imaging member of claim 2, wherein the organometallic compound is selected from a group consisting of monoacetyl acetonate zirconium tributoxide, ethyl acetoacetate zirconium trialkoxide, lactic acid zirconium trialkoxide, monoacetyl acetonate titanium tributoxide, ethyl acetoacetate titanium trialkoxide, lactic acid titanium trialkoxide, diisobutyloleyl acetoacetyl aluminate, diisopropyloleyl acetoacetyl aluminate, and the like and mixtures thereof.

15. The imaging member of claim 2, wherein the organometallic compound is present in an amount of from about 10 to about 95 weight percent based on the weight of the undercoat layer.

16. The imaging member of claim 1, wherein the thiophosphate comprises a metal free thiophosphate or a metal thiophosphate.

17. The imaging member of claim 1, wherein the thiophosphate comprises a metal thiophosphate selected from the group consisting of zinc thiophosphate, molybdenum thiophosphate, lead thiophosphate, antimony thiophosphate, manganese thiophosphate, and mixtures and combinations thereof.

18. The imaging member of claim 1, wherein the thiophosphate is selected from the group consisting of materials having the following structures (4)

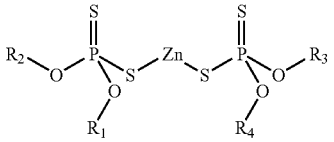

(5)

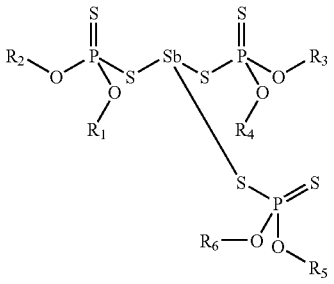

wherein $R_1$, $R_2$, $R_3$, $R_4$, $R_5$ and $R_6$ are each independently selected form the group consisting of hydrogen, an alkyl group having from about 1 to about 20 carbon atoms, a cycloalkyl group having form about 6 to about 26 carbon atoms, aryl, aklylaryl, arylaklyl, or a hydrocarbyl group having form about 3 to about 20 carbon atoms and containing an ester, ether, alcohol or carboxyl group, a straight chained alkyl group having from about 2 to about 18 carbon atoms, a branched alkyl group having from about 2 to about 18 carbon atoms, or mixtures or combinations thereof.

19. The imaging member of claim 1, wherein the thiophosphate comprises zinc dialkyldithiophosphate.

20. The imaging member of claim 1, wherein the thiophosphate is present in an amount of from about 0.01 to about 30 weight percent based on the weight of the undercoat layer.

21. The imaging member of claim 1, wherein at least one of the charge generation layer and the charger transport layer comprise thiophosphate, and wherein the thiophosphate is present in an amount of from about 0.01 to about 40 weight percent based on the weight of the charge generation layer, the charger transport layer, or a combined weight of the charge generation and charge transport layer.

22. The imaging member of claim 1, wherein the charge generation layer comprises a member selected from the group consisting of vanadyl phthalocyanine, metal phthalocyanines, metal-free phthalocyanine, hydroxygallium phthalocyanine, titanyl phthalocyanine, chlorogallium phthalocyanine, perylene, bis(benzimidazo)perylene and mixtures and combinations thereof

23. The imaging member of claim 1 wherein the charge transport layer is comprised of aryl amine molecules of the formula (13)

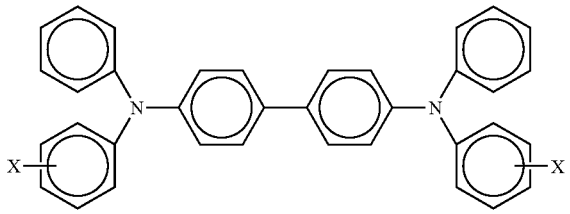

wherein X is selected from the group consisting of alkyl, alkoxy, aryl and halogen; and said alkyl contains from about 1 to about 10 carbon atoms.

24. The imaging member of claim 1 wherein the charge transport layer is comprised of aryl amine molecules, and which aryl amines are of the formula (14)

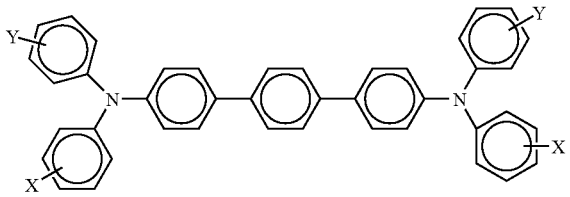

wherein each X and Y is independently selected from the group consisting of alkyl, alkoxy, aryl and halogen.

25. The imaging member in accordance with claim 1, wherein the charge transport layer is comprised of aryl amine molecules, and which aryl amines are selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, and mixtures and combinations thereof.

26. The imaging member in accordance with claim 1 wherein the charge transport layer is comprised of aryl amine mixtures.

27. The imaging member of claim 1 wherein the at least one charge transport layer contains an antioxidant optionally comprised of a hindered phenol or a hindered amine.

28. The imaging member of claim 1 wherein the at least one charge transport layer is from 1 to about 7 layers.

29. The imaging member of claim 1 wherein the at least one charge transport layer is comprised of a top charge transport layer and a bottom charge transport layer and wherein the bottom layer is situated between the charge generation layer and the top layer.

30. An imaging member comprising:

a substrate;

a charge generation layer positioned on the substrate;

at least one charge transport layer positioned on the charge generation layer; and an undercoat layer positioned on the substrate on a side opposite the charge generation layer, the undercoat layer comprising zinc dialkyldithiophosphate and optionally one or more additional undercoat layer components selected from the group consisting of binder components, metal oxides, silanes, organometallic compounds, and mixtures and combinations thereof.

31. An image forming apparatus for forming images on a recording medium comprising:

a) a photoreceptor member having a charge retentive surface to receive an electrostatic latent image thereon, wherein said photoreceptor member comprises a metal or metallized substrate, a charge generation layer positioned on the substrate; at least one charge transport layer positioned on the charge generation layer; and an undercoat layer positioned on the substrate on a side opposite the charge generation layer, the undercoat layer comprising a thiophosphate and optionally one or more additional undercoat layer components;

b) a development component to apply a developer material to said charge-retentive surface to develop said electrostatic latent image to form a developed image on said charge-retentive surface;

c) a transfer component for transferring said developed image from said charge-retentive surface to another member or a copy substrate; and d) a fusing member to fuse said developed image to said copy substrate.

* * * * *